United States Patent [19]

Auwärter et al.

[11] Patent Number: 4,926,819

[45] Date of Patent: May 22, 1990

[54] SYSTEM FOR INJECTING FUEL INTO COMBUSTION CHAMBERS OF AN INTERNAL COMBUSTION ENGINE

[75] Inventors: Gerhard Auwärter, Stuttgart; Ernst Imhof, Münchingen; Iwan Komaroff, Regensburg; Helmut Reum; Günther Schmid, both of Stuttgart; Bernhard Kaczynski, Waiblingen, all of Fed. Rep. of Germany

[73] Assignee: Robert Bosch GmbH, Stuttgart, Fed. Rep. of Germany

[21] Appl. No.: 271,755

[22] PCT Filed: Jan. 10, 1987

[86] PCT No.: PCT/DE87/00008

§ 371 Date: Sep. 14, 1988

§ 102(e) Date: Sep. 14, 1988

[87] PCT Pub. No.: WO87/05663

PCT Pub. Date: Sep. 24, 1987

[30] Foreign Application Priority Data

Mar. 22, 1986 [DE] Fed. Rep. of Germany ..... 3609749

[51] Int. Cl.[5] ..... F02M 53/06; F02B 9/08

[52] U.S. Cl. ..... 123/297; 123/145 A

[58] Field of Search ..... 123/297, 298, 549, 145 A, 123/543, 254; 239/133

[56] References Cited

U.S. PATENT DOCUMENTS

| | | | |
|---|---|---|---|
| 2,628,600 | 2/1953 | Malin | 123/298 |
| 3,996,915 | 12/1976 | Demetrascu | 123/297 |
| 4,603,667 | 8/1986 | Grünwald et al. | 123/145 A |
| 4,604,975 | 8/1986 | Fray et al. | 123/145 A |
| 4,766,801 | 8/1988 | Finstarwalder | 123/254 |
| 4,788,953 | 12/1988 | Kacqynski et al. | 123/297 |
| 4,821,696 | 4/1989 | Kaczynski et al. | 123/298 |

*Primary Examiner*—Raymond A. Nelli

*Attorney, Agent, or Firm*—Michael J. Striker

[57] ABSTRACT

A system for injecting fuel into the combustion chambers of an internal combustion engine, comprising an injection nozzle and a glow coil which is connected downstream and is enclosed by a sleeve. The sleeve contacts one end of the glow coil on the combustion chamber side and is connected with a current lead. The other end of the glow coil is grounded via a contact ring body, a heat protecting ring and the nozzle body of the injection mozzle. This arrangement has the advantage that an insulation of the contact ring body relative to the heat protection ring is dispensed with and the latter can be supported immediately at the contact ring body.

10 Claims, 3 Drawing Sheets

FIG. 1
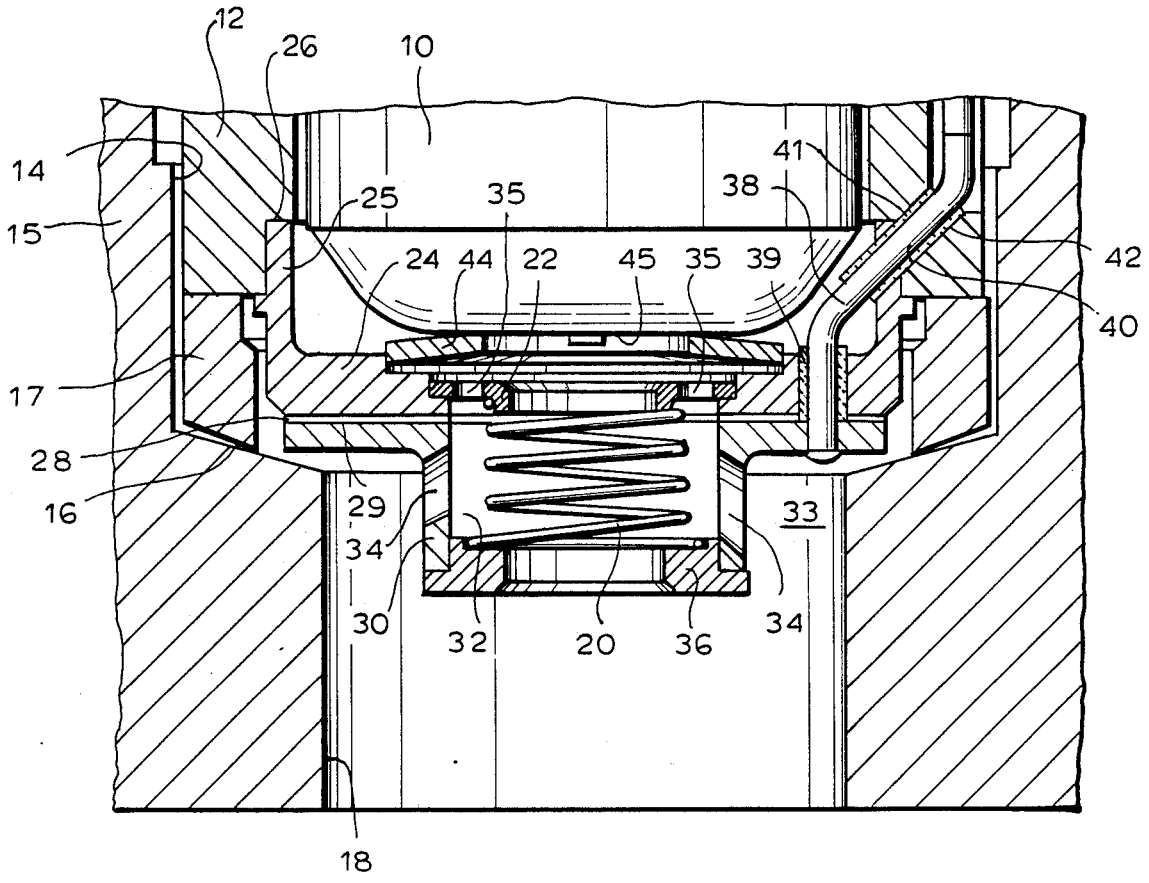
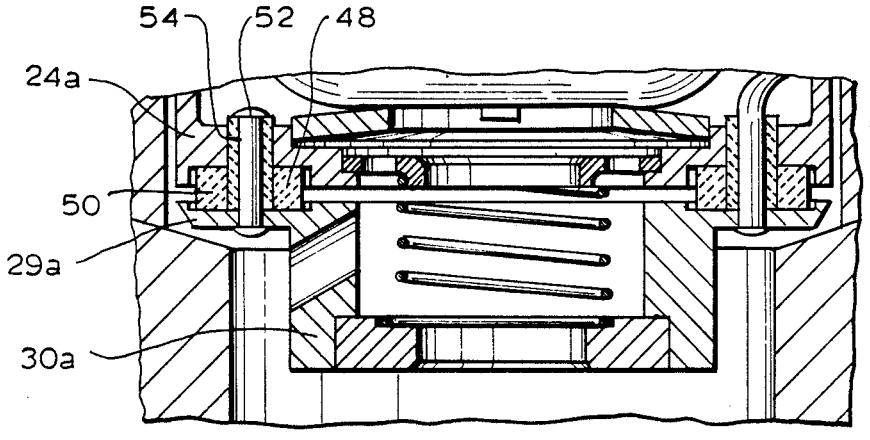
FIG. 2

SYSTEM FOR INJECTING FUEL INTO COMBUSTION CHAMBERS OF AN INTERNAL COMBUSTION ENGINE

BACKGROUND OF INVENTION

This invention relates to fuel injection systems and more particularly to an improved system for injecting fuel into the combustion chambers of an internal combustion engine.

In fuel injection systems of the known type current lead is guided to a contact ring body and connected with the latter, while a sleeve, which encloses the glow coil and supports its end at a combustion chamber side, is connected with a cap nut of a injection nozzle so as to be electrically conductive and forms a part of a ground conductor. In this construction, a contact ring body is insulated relative to the sleeve and relative to a heat protection ring, for which purpose two ceramic rings and another metallic ring body are provided, the heat protection ring being supported at the latter.

SUMMARY OF INVENTION

The invention is directed to a system for injecting fuel into the combustion chambers of an internal combustion engine, comprising, in combination: a nozzle body having a front side, a glow coil having two ends, a sleeve enclosing the glow coil at a radial distance therefrom, the sleeve having at least one aeration opening leading into the annular space between the sleeve and the glow coil, allowing air to enter the boundary zones of the injection jets from the combustion chamber by means of injection action, a contact ring body for mounting the glow coil and sleeve downstream from the front end of the nozzle body, one end of the glow coil making contact with and being supported at the sleeve and the other end of the glow coil being in electrical connection with the contact ring body, means for electrically insulating the sleeve from the contact ring body, an axially springing heat protection ring interposed between the contact ring body and the front side of the nozzle body and a current lead extending along the nozzle body and making electrical connection with the sleeve, the arrangement being such that the sleeve and contact ring body provide a conductive path for carrying current through the glow coil from the current lead.

The fuel injection system according to the invention has the advantage that the need for an insulation of the contact ring body relative to the heat protection ring is dispensed with and the latter can be supported directly at the contact ring body. Accordingly, the assembly of the glow attachment can be facilitated in many cases.

Advantageous developments of the fuel injector system according to the invention are possible which simplify its construction and assembly.

In devices in which the nozzle body is clamped at a nozzle holder by means of a cap nut, simple constructions of the sleeve and contact ring body result when the contact ring body is fastened at the front end of the cap nut at the combustion chamber side and the current lead is guided through the contact ring body so as to be insulated.

A disk, which is at least substantially flat, can serve as a contact ring body when the sleeve is provided with an annular rim which projects radially over the contact ring body, is fastened at the front end of the cap nut on the combustion chamber side so as to be electrically insulated, and which is connected with the current lead.

The contacting of the sleeve can be facilitated and simplified if its annular rim overlaps the nozzle body by a distance with play. In this case, it can be advisable to introduce the annular rim into an expanded bore hole portion of the cap nut, a transverse bore hole of the cap nut, which facilitates the contacting with the current lead, opening into this expanded bore hole portion. The sleeve or its annular rim, respectively, then forms a part of the cap nut to a certain extent, which can be constructed so as to be correspondingly shorter than in the conventional constructions.

If the annular rim is provided with an external annular shoulder for the purpose of support at an inner shoulder in the housing bore hole receiving the parts, which annular shoulder faces away from the cap nut, a fastening of the sleeve at the cap nut can, under certain circumstances, be entirely dispensed with. In this case, the sleeve is clamped at the inner shoulder of the housing bore hole by means of the cap nut, wherein the heat protection ring is simultaneously elastically deformed in the desired manner. Ceramic rings, which can also be soldered at least with the sleeve with corresponding surface treatment, can serve in an advantageous manner for the electrical insulation of the sleeve relative to the housing and the cap nut.

BRIEF DESCRIPTION OF THE DRAWING

The invention will now be described in greater detail with particular reference to the accompanying drawing wherein:

FIG. 1 is an elevational sectional view of a fuel injection system according to the invention;

FIG. 2 is a similar view of a modification of the fuel injection system shown in FIG. 1;

DESCRIPTION OF THE PREFERRED EMBODIMENTS

Figure 3:
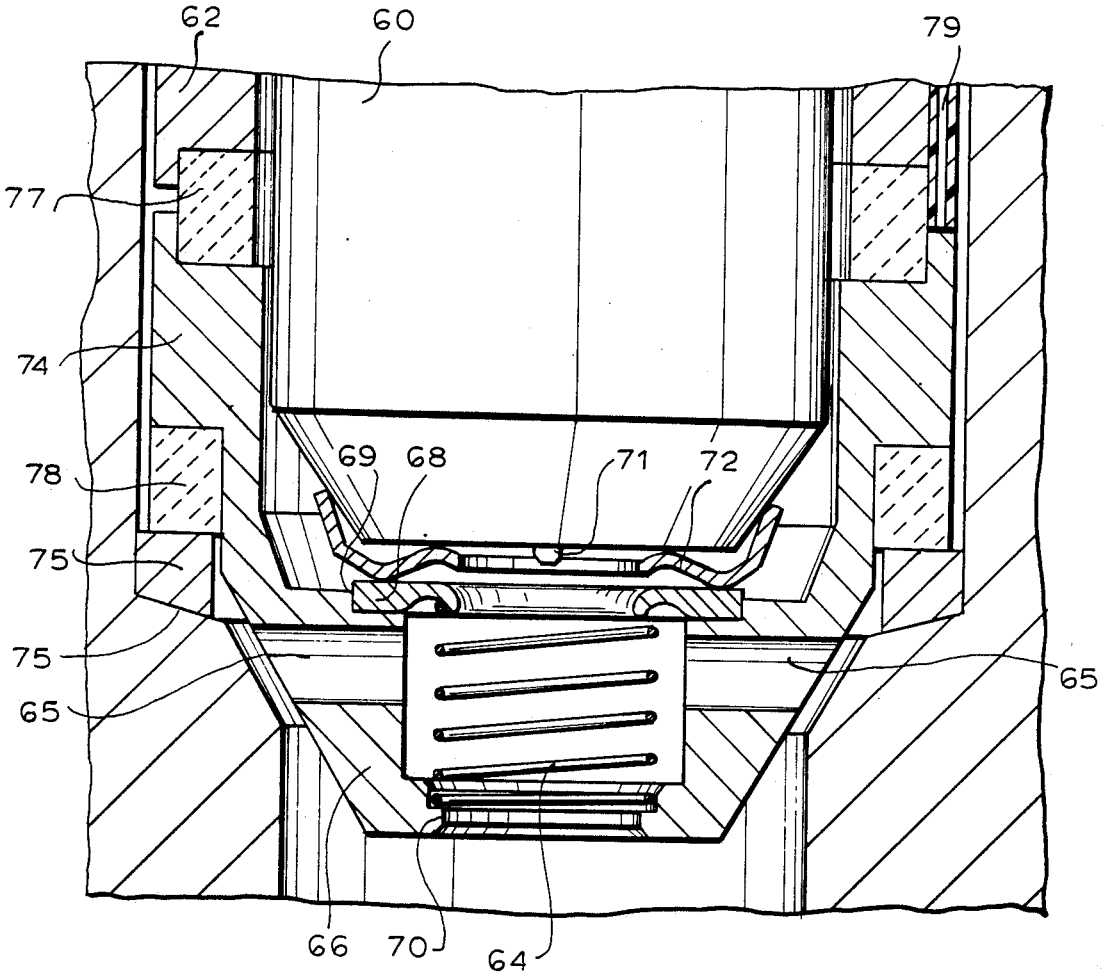
FIG. 3 is an elevational sectional view of a fuel injection system according to another embodiment of the invention.

The general arrangement of a fuel injection system according to the invention is shown in FIG. 1 wherein an injection nozzle has a nozzle body 10 which is tightened against a nozzle holder, not shown, by means of a cap nut 12. The injection nozzle is fastened in a bore hole 14 of the housing 15 of the internal combustion engine by means of the cap nut !2, the bore hole 14 being sealed outwardly by means of a sealing ring 17 which is clamped in between the front side of the cap nut 12 and an annular shoulder 16. A necked down bore hole portion 18 adjoins the annular shoulder 16 and opens out of the housing 15 at the combustion chamber side.

A glow coil 20 is connected downstream of the nozzle body 10, the fuel injection jets passing through the glow coil 20 without contact. The end of the glow coil 20 facing the nozzle body 10 is connected with a contact ring body 24 via an intermediate disk 22 in a fixed manner and so as to be electrically conductive, the contact ring body 24 being provided with a raised rim 25. The rim 25 overlaps the front end of the nozzle body 10 and extends into a recess 26 of the cap nut 12 on the front side, with which it is connected in a fixed manner and so as to be electrically conductive.

A flanged rim 29 of a sleeve 30, which encloses the glow coil 20 with radial play, is fastened at the contact ring body 24 via an electrically insulating intermediate disk 28. The fastening can be effected in a suitable manner, e.g. by means of cementing or by means of rivets. An annular space 32 is formed between the sleeve 30 and the glow coil 20, and an annular space 33 is formed between the sleeve 30 and the wall of the bore hole 18. The annular spaces 32 and 33 communicate with one another via bore holes 34 in the sleeve 30, and the intermediate disk 22 is provided with a plurality of bore holes 35 in the area of the annular space 32.

The end of the sleeve 30 on the combustion chamber side is connected with an annular plate 36 in a fixed manner so as to be electrically conductive, the lower end of the glow coil 20 being fastened to and making contact with the annular plate 36. In addition, the sleeve 30 is connected with an electrical lead 38 which is guided through the flat portion of the contact ring body 24 so as to be insulated in a nonconductive bush 39. The lead 38 is guided through a cut out portion 41 of the rim in the contact ring body 24 and through a transverse bore hole 42 in the cap nut 12 in a nonconductive bush 40 so as to be insulated. The outer rim of a slightly curved, resiliently springing heat protection ring 44, whose inner rim contacts the front side 45 of the nozzle body 10 under tension, is supported at the contact ring body 24.

In the operation of the described arrangement, the injection jets pass through the glow coil 20, wherein air is sucked out of the combustion chamber via the annular space 33, the bore holes 34 and 35 and the spaces between the coils of the glow coil 20 by means of injector action. The air is heated at the heated glow coil 20 and penetrates in its interior into the boundary zones of the injection jets, where a fuel-air mixture results which is very favorable for ignition and combustion and ignites reliably when entering the combustion chamber.

The lead 38 for the heating current of the glow coil 20 is guided to the end of the glow coil 20 on the combustion chamber side via the sleeve 34, whereas the contact ring body 24 and the heat protection ring 44 serve as ground conductors. This arrangement has the advantage that the contact ring body 24 need not be insulated relative to the cap nut 12 and the heat protection ring 44 and corresponding intermediate layers are therefore dispensed with.

FIG. 2 shows another embodiment of the fuel injection system according to the invention which differs from the above-described construction in that two ceramic rings 48, 50 are provided as insulating bodies between the flange 29*a* of the sleeve 30*a* and the contact ring body 24*a*, the parts being tightened relative to one another by means of rivets 52 which are inserted in insulating bushes 54. In addition, a solder connection can be provided via the ceramic rings 48, 50 if their side surfaces are provided with a coating capable of being soldered.

FIG. 3, shows still another embodiment of the fuel injection system including an injection nozzle with a nozzle body 60, a cap nut 62 and a glow coil 64 which is enclosed by a sleeve 66 provided with transverse bore holes 65, a contact ring body 68 being fastened at the sleeve 66 in a fixed manner so as to be insulated. The insulation is effected in this instance by means of a coating 69 on the side wall facing the sleeve 66 and on the circumferential rim of the contact ring body 68. The glow coil 64 is fastened at and makes contact with an inner annular collar 70 of the sleeve 66 and the contact ring body 68. A heat protection ring 72 is clamped in between the contact ring body 68 and the facing front side 71 of the nozzle body 60, the upper end of the glow coil 64 being grounded via the heat protection ring 72.

The sleeve 66 is connected with an annular body 74 so as to form one piece, the annular body 74 overlapping the nozzle body 60 by a distance and being tightened against an annular shoulder 76 of the engine housing by means of the cap nut 62 via a metallic sealing ring 75. The annular body 74 is insulated against the cap nut 62 and the sealing ring 75 by means of ceramic rings 77, 78, one of which 77 also serves to center the annular body 74. The rings 77 and 78 can also be provided with solderable coatings at their flat side surfaces and ca be soldered with the adjoining parts. A lead 79, which is guided through a longitudinal groove in the circumference of the outer surface of the cap nut 62 so as to be insulated, is soldered on at the annular body 74.

Figure 4:
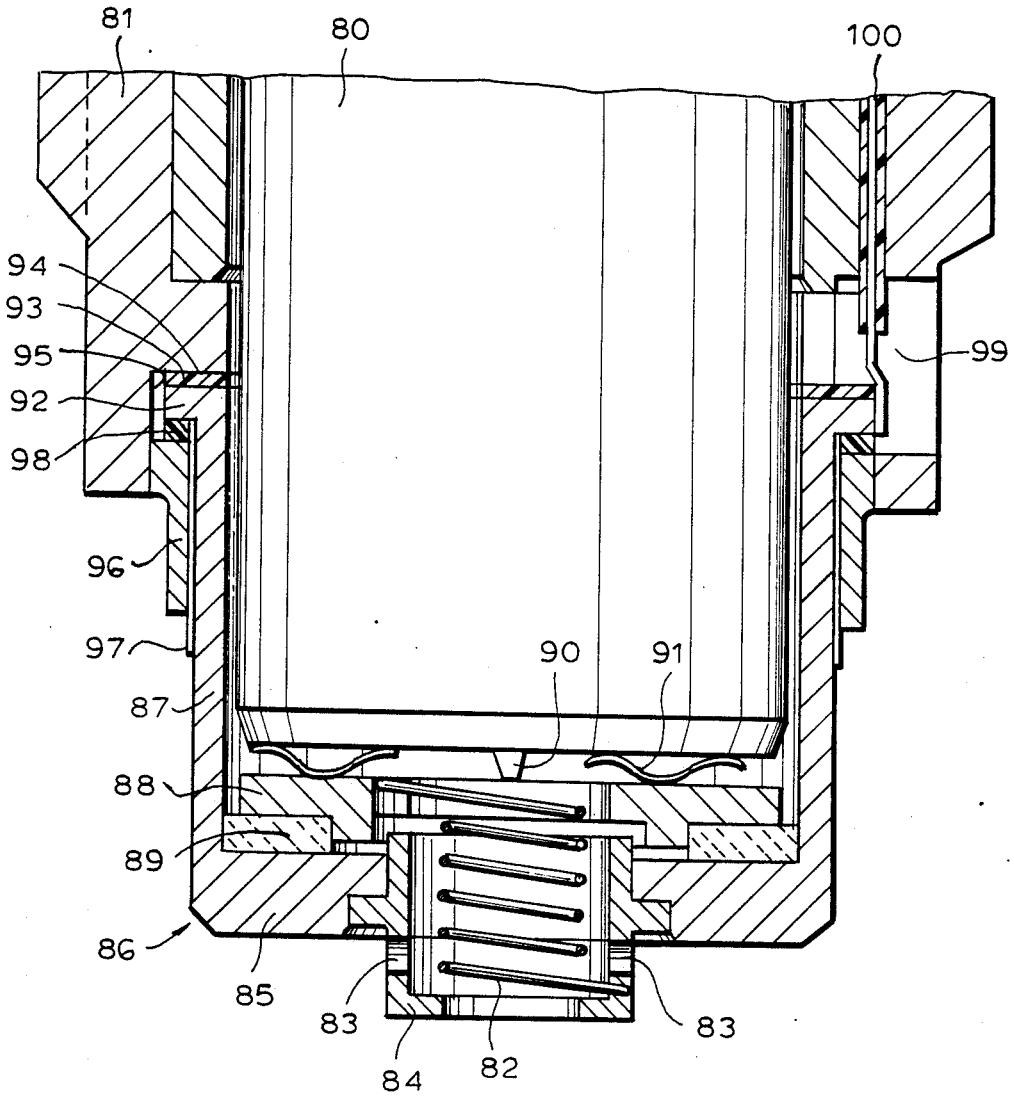
FIG. 4 is a similar view of a fuel injection system according to still another embodiment of the invention.

In the embodiment of the fuel injection system shown in FIG. 4, a nozzle body 80 is tightened against a nozzle holder by means of a cap nut 81 and fixed in a bore hole of an engine housing. A glow coil 82 is connected downstream of the nozzle body 80, which glow coil 82 is enclosed by a sleeve 84 provided with bore holes 83, the sleeve 84 holding and making contact with the lower end of the glow coil 82. The sleeve 84 is soldered into the base 85 of a cup body 86 so as to be fixed, the outer surface 87 of the cup body 86 overlapping the nozzle holder 80 by a distance and being fastened at the cap nut 81 so as to be insulated in the manner described in more detail in the following.

The upper end of the glow coil 82 is connected with a contact ring body 88 which is connected with the cup body 86 via a ceramic disk 89 so as to be fixed, e.g. by means of soldering or cementing. A heat protection ring 91 is clamped in between the contact ring body 88 and the facing front side 90 of the nozzle body 80, the upper end of the glow coil 82 being grounded with the heat protection ring 91.

The cup body 86 has a flanged rim 92 which is supported at the base surface 94 of a recess 95 on the front side of the cap nut 81 with the intermediary of an insulating disk 93. The cup body 86 is pressed against the base surface 94 by means of an annular body 96 which is slid on and subsequently welded with the cap nut 81. The annular body 96 is insulated relative to the cup body 86 by means of an intermediate sleeve 97, which is not electrically conductive, and an annular disk 98. A radial bore hole 99 is provided in the cap nut 81, a lead 100, which is guided through the cap nut 81 so as to be insulated, projects into the radial bore hole 99 and is soldered on at the flanged rim 92 of the cup body 86.

We claim:

1. A system for injecting fuel into the combustion chambers of an internal combustion engine comprising, in combination:

a nozzle body having a front side;

a glow coil having two ends;

a sleeve enclosing said glow coil at a radial distance therefrom, said sleeve having at least one aeration opening leading into the annular space between said sleeve and said glow coil allowing air to enter the boundary zones of the injection jets from said combustion chamber by means of injector action;

a contact ring body for mounting said glow coil and said sleeve downstream from said front side of said nozzle body, one end of said glow coil making contact with and being supported at said sleeve and the other end of said glow coil being in electrical connection with said contact ring body;

means for electrically insulating said sleeve from said contact ring body;

an axially springing heat protection ring interposed between said contact ring body and said front side of said nozzle body; and a current lead extending along said nozzle body and making electrical connection with said sleeve, the arrangement being such that said sleeve and said contact ring body provide a conductive path for carrying current through said glow coil from said current lead.

2. The fuel injection system according to claim 1, further including a cap nut for clamping said nozzle body onto a nozzle holder.

3. The fuel injection system according to claim 2, wherein said contact ring body is fastened at the front end of said cap nut on the combustion chamber side, and wherein said current lead is guided through said contact ring body.

4. The fuel injection system according to claim 3, further including means for electrically insulating said current lead from said contact ring body.

5. The fuel injection system according to claim 2, wherein said sleeve is provided and connected, respectively, with an annular wall which projects radially over said contact ring body and which is fastened at the front end of said cap nut on the combustion chamber side, and wherein said current lead is electrically connected to said annular wall.

6. The fuel injection system according to claim 5, further including means for electrically insulating said annular wall from said cap nut.

7. The fuel injection system according to claim 6, wherein said annular wall overlaps said nozzle body by distance with play.

8. The fuel injection system according to claim 7, wherein said annular wall is provided with an outer annular shoulder for supporting said sleeve at an inner shoulder of a housing bore hole, said outer shoulder facing away from said cap nut.

9. The fuel injection system according to claim 8, wherein said cap nut has an expanded bore hole portion for receiving said annular wall and a transverse bore hole opening into said expanded bore hole which facilitates making electrical connection of said current lead.

10. The fuel injection system according to claim 1, wherein said insulating means are ceramic rings having at least one surface thereof treated with a solderable material.

* * * * *